US007284289B1

(12) United States Patent
Biagini

(10) Patent No.: US 7,284,289 B1
(45) Date of Patent: Oct. 23, 2007

(54) INFANT TRAVEL BED

(76) Inventor: Donna Biagini, 36 Florida Ave., Commack, NY (US) 11725

( * ) Notice: Subject to any disclaimer, the term of this patent is extended or adjusted under 35 U.S.C. 154(b) by 0 days.

(21) Appl. No.: 11/436,074

(22) Filed: May 17, 2006

(51) Int. Cl.
*A47D 13/06* (2006.01)

(52) U.S. Cl. ..... 5/99.1; 5/98.1

(58) Field of Classification Search ..... 5/98.1, 5/98.2, 99.1; 135/126
See application file for complete search history.

(56) References Cited

U.S. PATENT DOCUMENTS

| | | | | |
|---|---|---|---|---|
| 4,044,411 | A | 8/1977 | Peterson | |
| 4,070,716 | A | 1/1978 | Satt et al. | |
| 4,366,587 | A | 1/1983 | Takada | |
| 4,698,862 | A | 10/1987 | Mairs | |
| 4,819,285 | A | 4/1989 | Fetters | |
| 4,852,598 | A | 8/1989 | Griesenbeck | |
| 5,473,785 | A | 12/1995 | Lager et al. | |
| 5,560,385 | A | 10/1996 | Zheng | |
| 5,642,538 | A * | 7/1997 | McAllister | 5/99.1 |
| 5,664,596 | A | 9/1997 | Zheng | |
| 5,800,067 | A * | 9/1998 | Easter | 383/104 |
| 5,806,924 | A | 9/1998 | Gonas | |
| 5,816,279 | A | 10/1998 | Zheng | |
| 6,006,772 | A | 12/1999 | Zheng | |
| 6,082,386 | A | 7/2000 | Zheng | |
| 6,092,544 | A | 7/2000 | Zheng | |
| 6,138,701 | A | 10/2000 | Zheng | |
| 6,192,635 | B1 | 2/2001 | Zheng | |
| 6,220,265 | B1 | 4/2001 | Zheng | |
| 6,266,904 | B1 | 7/2001 | Zheng | |
| 6,267,128 | B1 | 7/2001 | Zheng | |
| 6,267,129 | B1 | 7/2001 | Zheng | |
| 6,269,826 | B1 | 8/2001 | Zheng | |
| 6,289,910 | B1 * | 9/2001 | Zheng | 135/125 |
| 6,305,396 | B1 | 10/2001 | Zheng | |
| 6,309,111 | B1 | 10/2001 | Zheng | |
| 6,357,510 | B1 | 3/2002 | Zheng | |
| 6,360,761 | B1 | 3/2002 | Zheng | |
| 6,449,147 | B2 | 9/2002 | Zheng | |
| 6,453,923 | B2 | 9/2002 | Zheng | |
| 6,491,052 | B1 | 12/2002 | Zheng | |
| 6,527,136 | B1 * | 3/2003 | Sabounjian | 220/9.2 |
| 6,546,574 | B1 | 4/2003 | Bader | |
| 6,554,343 | B2 | 4/2003 | Sugiyama | |
| 6,557,192 | B2 | 5/2003 | Zheng | |
| 6,560,095 | B1 | 5/2003 | Zheng | |
| 6,575,185 | B2 | 6/2003 | Zheng | |
| 6,687,928 | B1 * | 2/2004 | Wilson | 5/99.1 |
| 6,694,994 | B1 | 2/2004 | Zheng | |
| 6,702,374 | B2 | 3/2004 | Kams | |

(Continued)

*Primary Examiner*—Michael Trettel
(74) *Attorney, Agent, or Firm*—Galgano & Associates, PLLC

(57) ABSTRACT

A collapsible infant travel bed includes four hoops, preferably all the same or similar size. One hoop is placed on the bottom and is connected to two side hoops and one hoop is connected to the tops of the side hoops. The side hoops are preferably covered with a see-through mesh fabric. The short ends at the head and the foot of the bed may be provided with mesh or opaque fabric, but it is preferred that at least the head be see-through mesh. A removable mattress is placed in the bed and one or more side cushions are arranged above the mattress. The bed is easily collapsed by pressing one of the side hoops toward the bottom hoop and then the other side hoop. A carrying case is provided for storing and carrying the collapsed bed.

18 Claims, 5 Drawing Sheets

U.S. PATENT DOCUMENTS 6,851,136 B2 * 2/2005 Brereton ..... 5/102
6,881,114 B2 4/2005 Zheng
6,901,940 B2 6/2005 Zheng
2006/0117478 A1 * 6/2006 Cheung ..... 5/99.1

* cited by examiner

INFANT TRAVEL BED

BACKGROUND OF THE INVENTION

1. Field of the Invention

This invention relates broadly to infant accessories. More particularly, this invention relates to a light weight, collapsible, infant travel bed.

2. State of the Art

Infants require a growing number of accessories for their safety and comfort. While in the past it might have been acceptable to wrap an infant in a blanket and place the infant on a sofa, chair, bed or table, that practice is no longer considered desirable. For the infant's protection, it is preferred that the infant be placed in a bed having four sides like a crib to prevent the infant from falling out. Such a bed may also protect furniture from the many fluids disbursed by an infant during the course of a day.

The patent literature is rich with examples of various infant carriers, containers, and beds. Given the plethora of modern required infant accessories, however, light weight and compact size are important considerations. The existing infant travel beds are relatively bulky and have significant weight.

SUMMARY OF THE INVENTION

It is therefore an object of the invention to provide an infant travel bed.

It is another object of the invention to provide an infant travel bed which protects the infant.

It is a further object of the invention to provide an infant travel bed which protects the infant's surroundings.

It is also an object of the invention to provide an infant travel bed which is light weight.

It is an additional object of the invention to provide an infant travel bed which is compact.

In accord with these objects, which will be discussed in detail below, an infant travel bed according to the invention includes a plurality of resilient hoops covered with fabric forming a container having four sides, a bottom and an open top. A removable mattress is placed in the container and preferably one or more side cushions are arranged above the mattress. According to the presently preferred embodiment, the infant travel bed is made from four hoops, preferably all the same or similar size. One hoop is placed on the bottom and is connected to two side hoops and one hoop is connected to the tops of the side hoops. The side hoops are preferably at least partially covered with a see-through mesh fabric. The short ends at the head and the foot of the bed may be provided with mesh or opaque fabric, but it is preferred that at least the head be at least partially see-through mesh. The presently preferred dimensions for the bed are 28 inches long by 12 inches wide by 13 inches tall. The bed is easily collapsed by pressing one of the side hoops toward the bottom hoop. This causes the top hoop to hinge (in opposite directions) at it connections to the side hoops. The result is that the top hoop becomes substantially parallel to the other side hoop which is then folded down toward the bottom hoop. This results in the top hoop being interleaved between the two side hoops and all four hoops lie approximately parallel and substantially flat. Since the hoops are resilient, they typically will not stay totally flat in this collapsed position. Therefore, a releasable closure (e.g., VELCRO straps) is provided to hold them in this position. A carrying case for storing and transporting the collapsed bed may also be provided. The carrying case is preferably a lightweight zippered tote having a pair of handles or a shoulder strap.

Additional objects and advantages of the invention will become apparent to those skilled in the art upon reference to the detailed description taken in conjunction with the provided figures.

DETAILED DESCRIPTION

Figure 1:
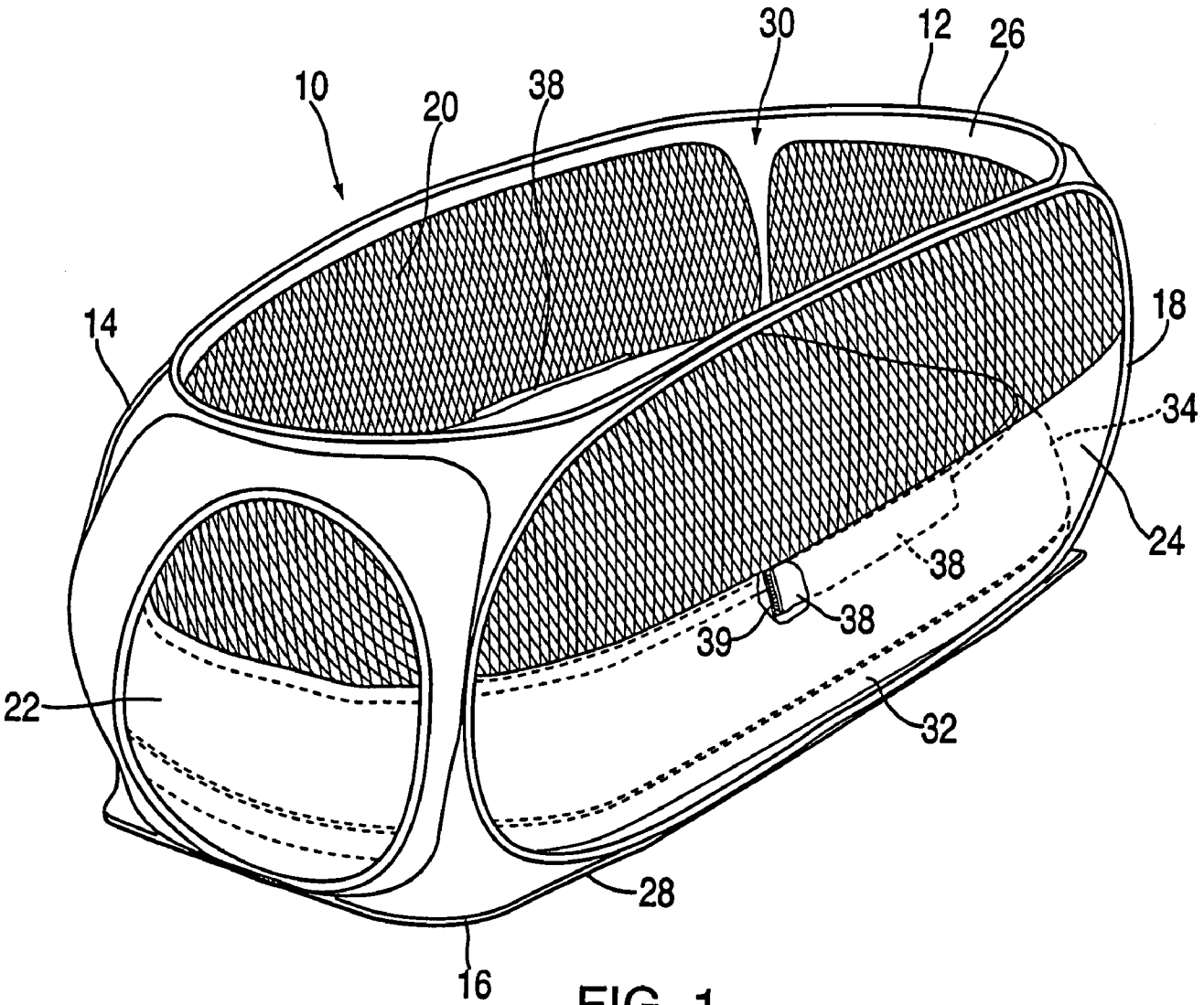
FIG. 1 is a perspective view of an infant travel bed according to the invention.
Figure 2:
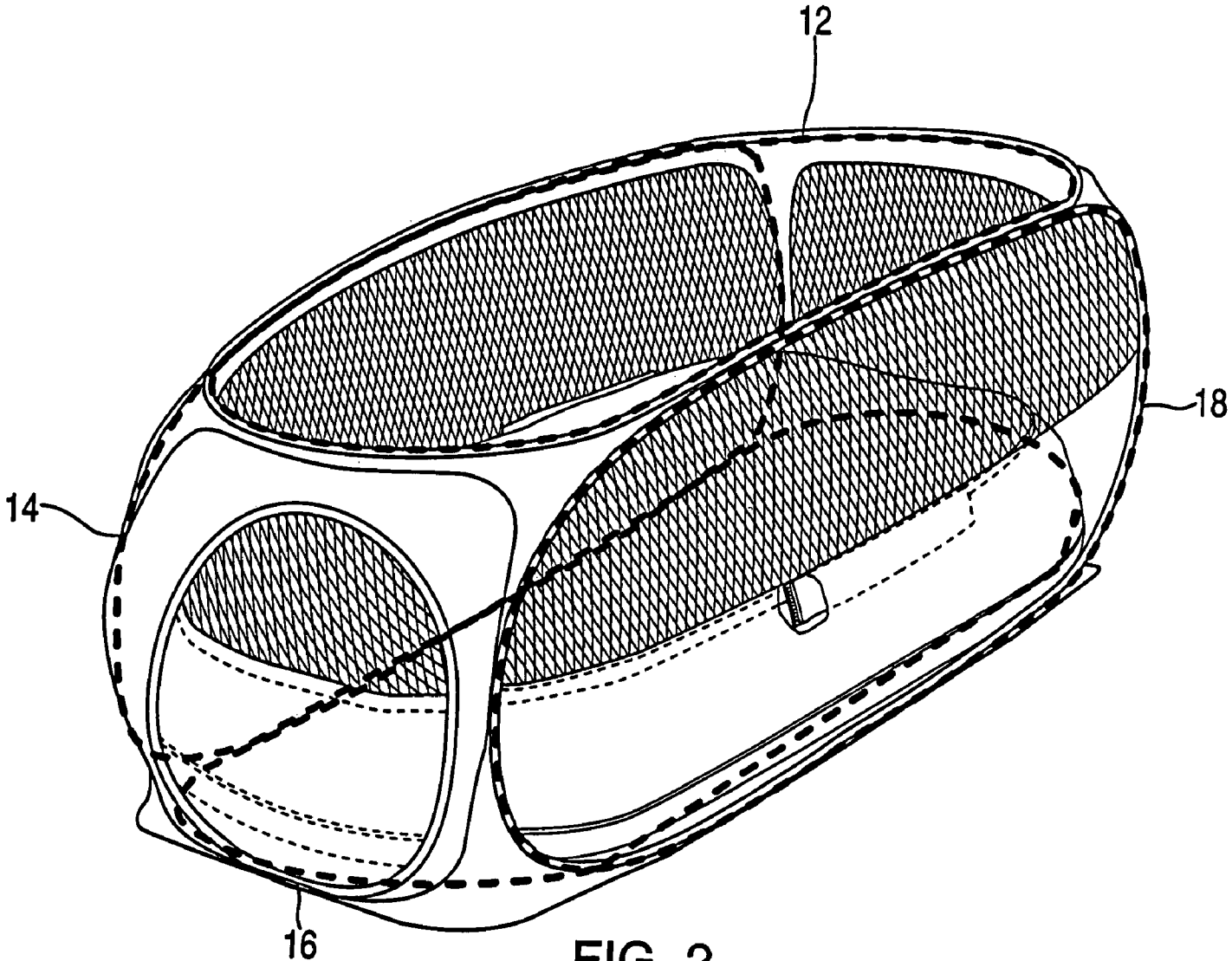
FIG. 2 is a view similar to FIG. 1 but showing the location of the resilient hoops in heavy dashed lines.

Turning now to FIGS. 1 and 2, an infant travel bed 10 according to the invention includes four resilient, preferably metal, oblong hoops 12, 14, 16, 18 covered with fabric forming a generally rectangular container having four sides 20, 22, 24, 26, a bottom 28 and an open top 30. The hoops may be coupled to each other via the fabric and/or they may be coupled to each other by wire, string, or the like. A removable mattress 32 is placed in the container and one or more side cushions 34 are arranged above the mattress 32. According to the presently preferred embodiment, a single side cushion 34 is arranged around the periphery of the mattress 32 and is releasably secured to the sides 20, 24 by VELCRO® hook and loop fasteners 38, 39 or equivalent mechanical fasteners, one of which is attached to the side panels 20, 24 and the other of which is attached to the side cushion 34.

According to the presently preferred embodiment, the side hoops 14 and 18 are preferably partially covered with a see-through mesh fabric and the bottom 28 is preferably a solid panel. The short ends at the head 22 and the foot 26 of the bed may be provided with a full mesh or opaque fabric panel, but it is preferred that at least the upper portion of head 22 be see-through mesh. The presently preferred dimensions for the bed are 28 inches long by 12 inches wide by 13 inches tall.

Figure 3:
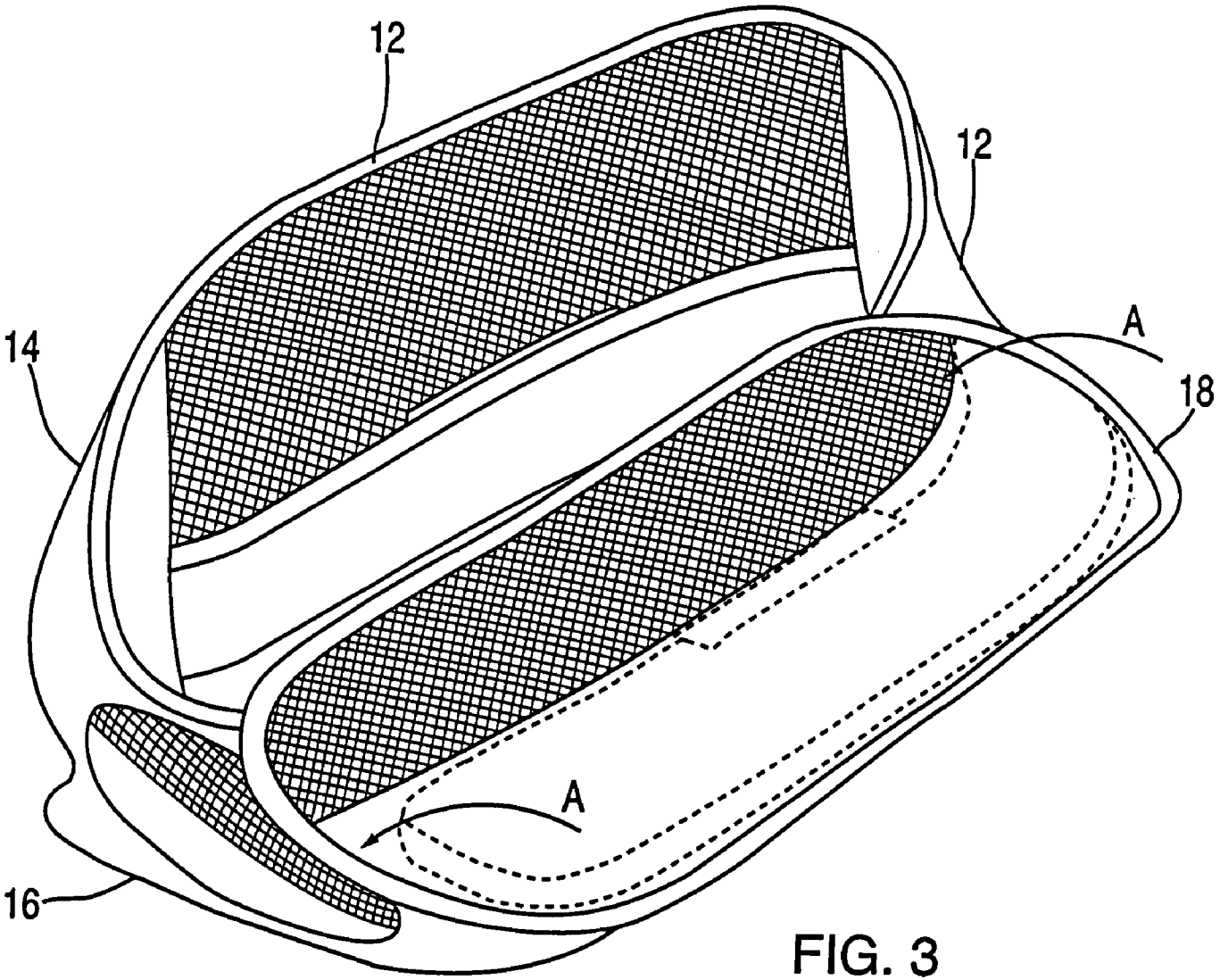
FIG. 3 is a perspective view of the infant travel bed in a partial state of collapse.
Figure 4:
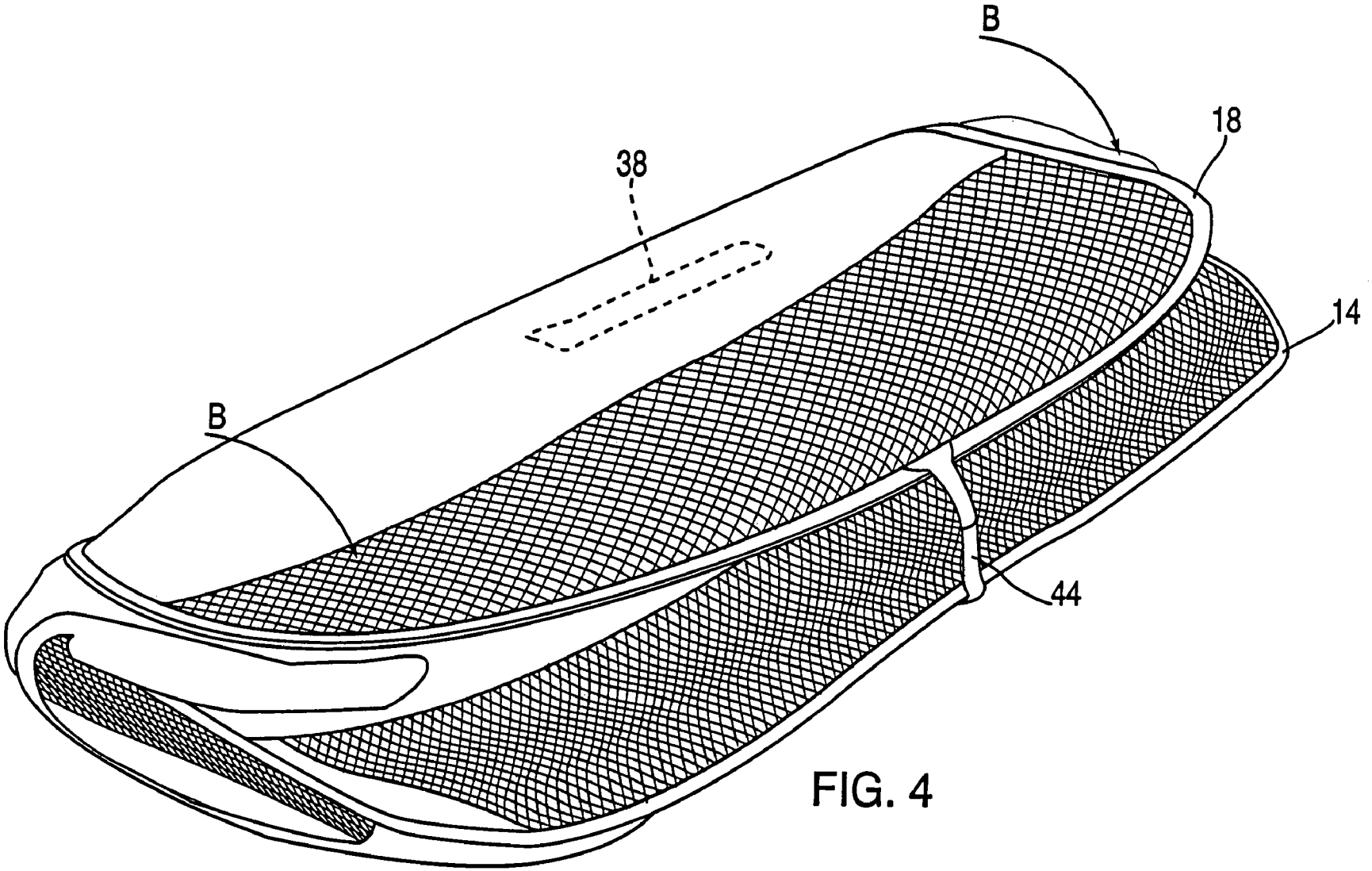
FIG. 4 is a perspective view of the infant travel bed in a fully collapsed state with the closure holding it in the collapsed state.
Figure 5:
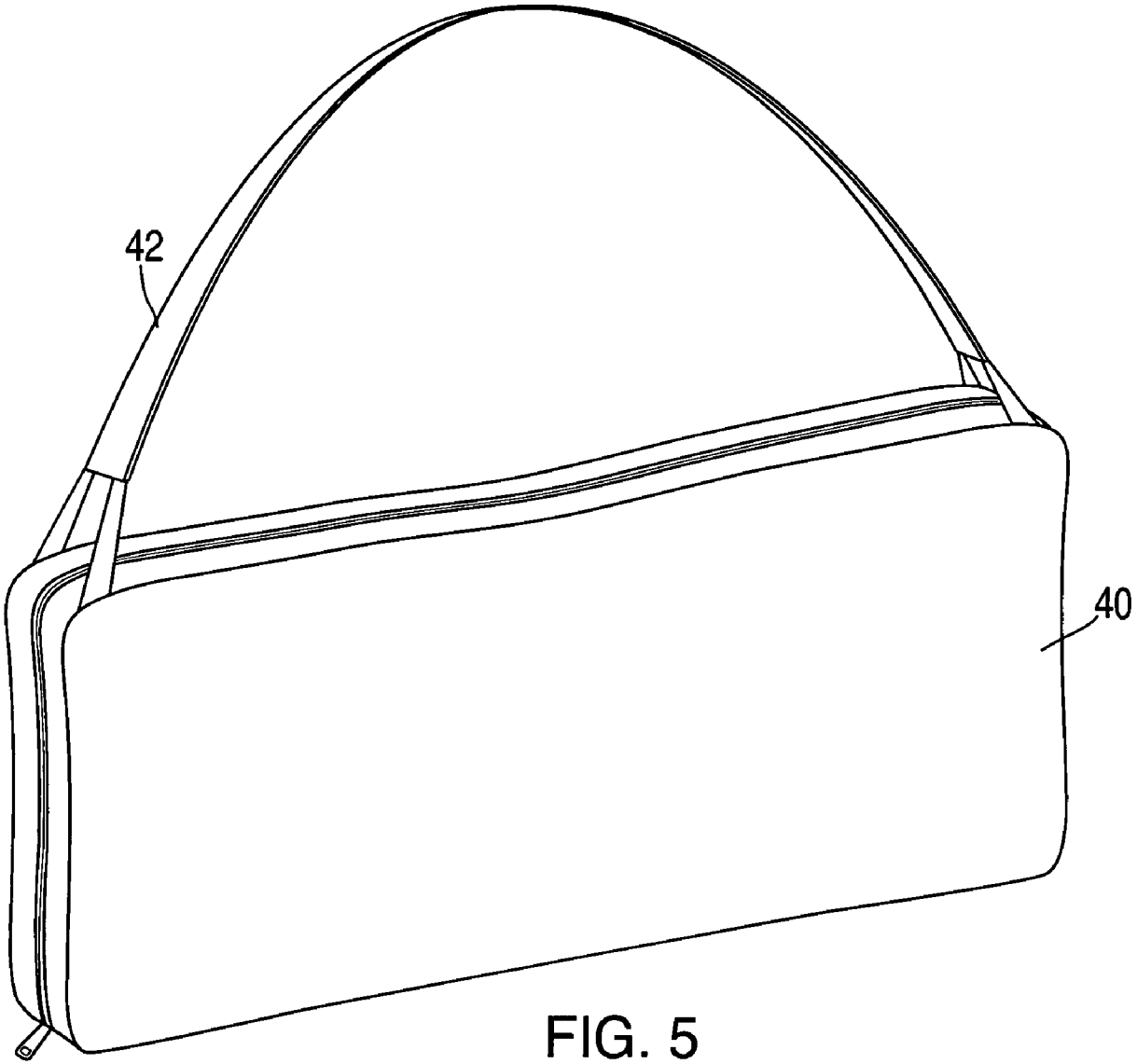
FIG. 5 is a perspective view of a zippered, carrying case for the infant travel bed provided with a carrying handle or strap.

Referring now to FIGS. 3 and 4, the bed 10 is easily collapsed by pressing one of the side hoops 14, 18 toward the bottom hoop 16. For example, as shown in FIG. 3, the side hoop 18 is moved in the direction shown by the arrows A toward the bottom hoop 16. This causes the top hoop 12 to hinge (in opposite directions) at its connections to the side hoops 14, 18. The result is that the top hoop 12 becomes substantially parallel with the side hoop 14 as shown in FIG. 3. The other side hoop 14 is then moved in the direction shown my arrows B in FIG. 4. This results in the top hoop being interleaved between the two side hoops and all four hoops lie approximately parallel and substantially flat as shown in FIG. 4. Since the hoops are resilient, they will typically not stay flat in this collapsed position. Therefore, it is preferable that a releasable closure 44 (e.g., a pair of VELCRO® hook and loop straps) be provided to hold them in this position. As shown in FIG. 5, a zippered carrying case or tote 40 preferably having a shoulder strap 42 may be provided for carrying the collapsed bed. The tote is preferably made from a lightweight waterproof material.

There has been described and illustrated herein a light weight collapsible infant travel bed. While particular embodiments of the invention have been described, it is not intended that the invention be limited thereto, as it is intended that the invention be as broad in scope as the art will allow and that the specification be read likewise. For example, although VELCRO® straps are used to attach the side cushion to the travel bed and as a releasable closure to hold the bed in a collapsed condition, other releasable fasteners such as, e.g., snap fasteners, could be used. In addition, although the infant bed is shown as a generally rectangular container having somewhat rounded corners, other configurations may be suitable depending upon the specific application. Similarly, the carrying case can also be of a variety of designs and could, e.g., be provided with a pair of carrying handles (not shown) rather than a strap or with other types of closures rather than a zipper. It will therefore be appreciated by those skilled in the art that yet other modifications could be made to the provided invention without deviating from its spirit and scope as claimed.

What is claimed is:

1. A collapsible infant travel bed, comprising:

a plurality of resilient hoops interconnected to each other;

five fabric panels coupled to said hoops and forming a container having four sides, a bottom, and an open top, said fabric panels include see-through mesh fabric on at least two of said four sides; and a mattress removably placed on the bottom of said container.

2. A bed according to claim 1, additional comprising a side cushion removably placed above the mattress.

3. A bed according to claim 2, wherein:

said mattress has a periphery and said side cushion extends around substantially all of said periphery.

4. A bed according to claim 1, wherein said container is generally rectangular.

5. A bed according to claim 1, wherein:

said plurality of hoops consists of four hoops, all substantially the same size, one bottom hoop forming the bottom of the bed, two side hoops forming opposite sides of the bed and one top hoop defining the open top.

6. A bed according to claim 5, wherein:

said side hoops are hingedly coupled to said top and bottom hoops and can be folded such that said top hoop is interleaved between said side hoops.

7. A bed according to claim 1, wherein:

said side cushion is removably affixed to at least one of said fabric panels.

8. A bed according to claim 1, additionally including a carrying case for storing and transporting sad bed in a collapsed state.

9. A bed according to claim 8, wherein said carrying case has at least one strap.

10. A collapsible infant travel bed, comprising:

a plurality of resilient hoops interconnected to each other, said plurality of hoops consisting of four hoops, all substantially the same size, one bottom hoop forming the bottom of the bed, two side hoops forming opposite sides of the bed and one top hoop defining the open top;

five fabric panels coupled to said hoops and forming a container having four sides, a bottom, and an open top; and a mattress removably placed on the bottom of said container.

11. A bed according to claim 10, additional comprising a side cushion removably placed above the mattress.

12. A bed according to claim 11, wherein:

said mattress has a periphery and said side cushion extends around substantially all of said periphery.

13. A bed according to claim 10, wherein said container is generally rectangular.

14. A bed according to claim 13, wherein:

said side hoops are hingedly coupled to said top and bottom hoops and can be folded such that said top hoop is interleaved between said side hoops.

15. A bed according to claim 10, wherein:

said fabric panels include see-through mesh fabric on at least two of said four sides.

16. A bed according to claim 15, wherein:

said side cushion is removably affixed to at least one of said fabric panels.

17. A bed according to claim 10, additionally including a carrying case for storing and transporting sad bed in a collapsed state.

18. A bed according to claim 17, wherein said carrying case has at least one strap.

* * * * *